United States Patent [19]

La Marca

[11] 4,188,054

[45] Feb. 12, 1980

[54] CLOSURE, PARTICULARLY FOR INDUSTRIAL FREEZER DOORS

[75] Inventor: Giuseppe La Marca, Milan, Italy

[73] Assignee: Intertecnica S.p.A., Milan, Italy

[21] Appl. No.: 940,951

[22] Filed: Sep. 11, 1978

[30] Foreign Application Priority Data

Sep. 20, 1977 [IT] Italy ..... 22264/73[U]

[51] Int. Cl.[2] ..... E05C 19/02

[52] U.S. Cl. ..... 292/226; 292/DIG. 49; 292/78

[58] Field of Search ..... 292/DIG. 72, DIG. 49, 292/DIG. 71, 226, 78, 79, 341.19

[56] References Cited

U.S. PATENT DOCUMENTS

| | | | |
|---|---|---|---|
| 1,394,126 | 10/1921 | Schmidgall | 292/DIG. 72 |
| 2,016,519 | 10/1935 | Schmidt | 292/DIG. 72 |
| 2,790,666 | 4/1957 | Vanderveld | 292/78 X |

*Primary Examiner*—Richard E. Moore

[57] ABSTRACT

A closure, particularly for industrial freezer doors is disclosed as comprising two elements, a box-like body having a top portion provided with a spring-loaded lever pivoted thereto, and a second element which is comprised of a suitably shaped latch pivoted to a mounting plate, said second element being snap insertable in the first element and retained by the latter by means of a "nose" element, thus providing a perfect closure.

5 Claims, 5 Drawing Figures

CLOSURE, PARTICULARLY FOR INDUSTRIAL FREEZER DOORS

This invention relates to closures particularly for application to industrial freezer doors.

The invention is particularly characterized by comprising two elements, that is a box-like body having a top portion provided with a spring-loaded lever pivoted thereto, there being provided at the bottom a specially shaped "nose" element pivoted to the side walls of said box-like body, said nose element being articulated by means of a plate to a spring guide element incorporating a spring and resting as an articulation on suitable notches; and a second element comprising a substantially mushroom shaped clapper pivoted to a mounting plate allowing a limited displacement thereof, said second element being snap insertable in the former and retained by the latter by means of said "nose" element, so as to ensure a correct closing operation.

The invention will be better understood from the following description and with reference to the accompnaying drawings, in which.

Figure 1:
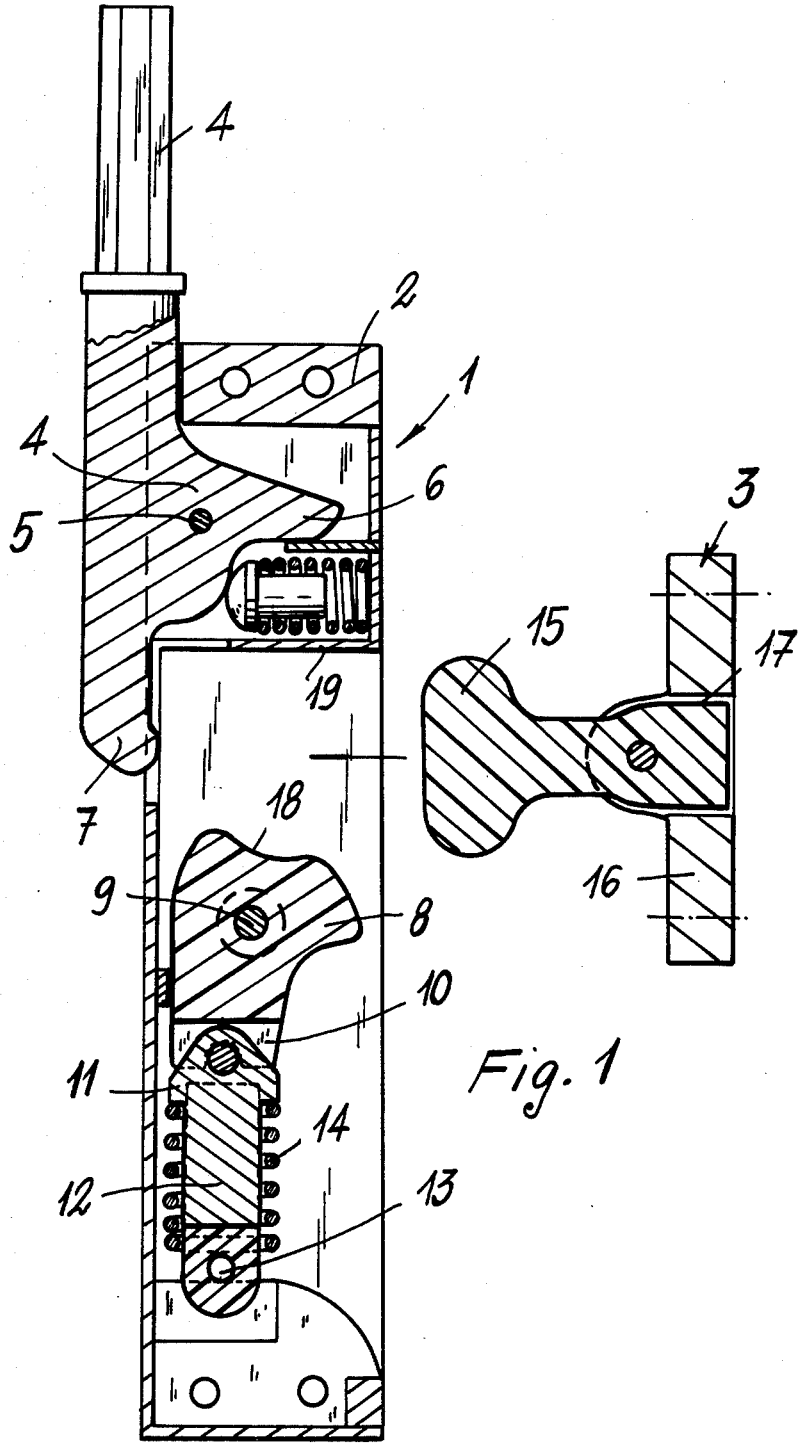
FIG. 1 is a side view showing the closure at open position.

Referring to the figures of the accompanying drawings, reference numeral 1 denotes a closure as a whole. Said closure 1 essentially comprises two elements designated as a whole at 2 and 3, respectively.

Element 2 is comprised of a box-like body substantially divided into two parts, a top partially closed part having a lever 4 urged by a spring gudgeon pin 4' pivoted by means of a pin 5 to the side walls of said box-like body. At the top, lever 4 is so shaped as to aid in a possible insertion of a knob, and at the bottom has extensions 6 and 7, of which the former or extension 6 is accomodated within the top part of the box-like body, while the second extension 7 is located at the outside.

At its second part, said box-like body has a suitably shaped nose 8, which is also pivoted to the side walls of the box-like body by means of a pin 9. At its bottom portion 10, said nose is articulated to a plate 11, the latter being secured to a spring guide 12, which is pivoted to a pin 13 and rests on suitable notches. This spring guide 12 incorporates a conventional spring 14.

Through screwing means, said element 1 is preferably applied to the doors of an industrial freezer.

The second element comprises a substantially mushroom shaped clapper 15 which is pivoted to a fastening plate 16.

The end portion of the shank of said mushroom member is inserted in a slightly larger slot 17 on the fastening plate, so that a short travel is permitted thereto.

Said second element is positioned on the stationary wall or on a doorpost, and at a level corresponding to the area which is between the top concave portion 18 of the nose and wall 19 of the top portion of said box-like body.

Figures 2, 3:
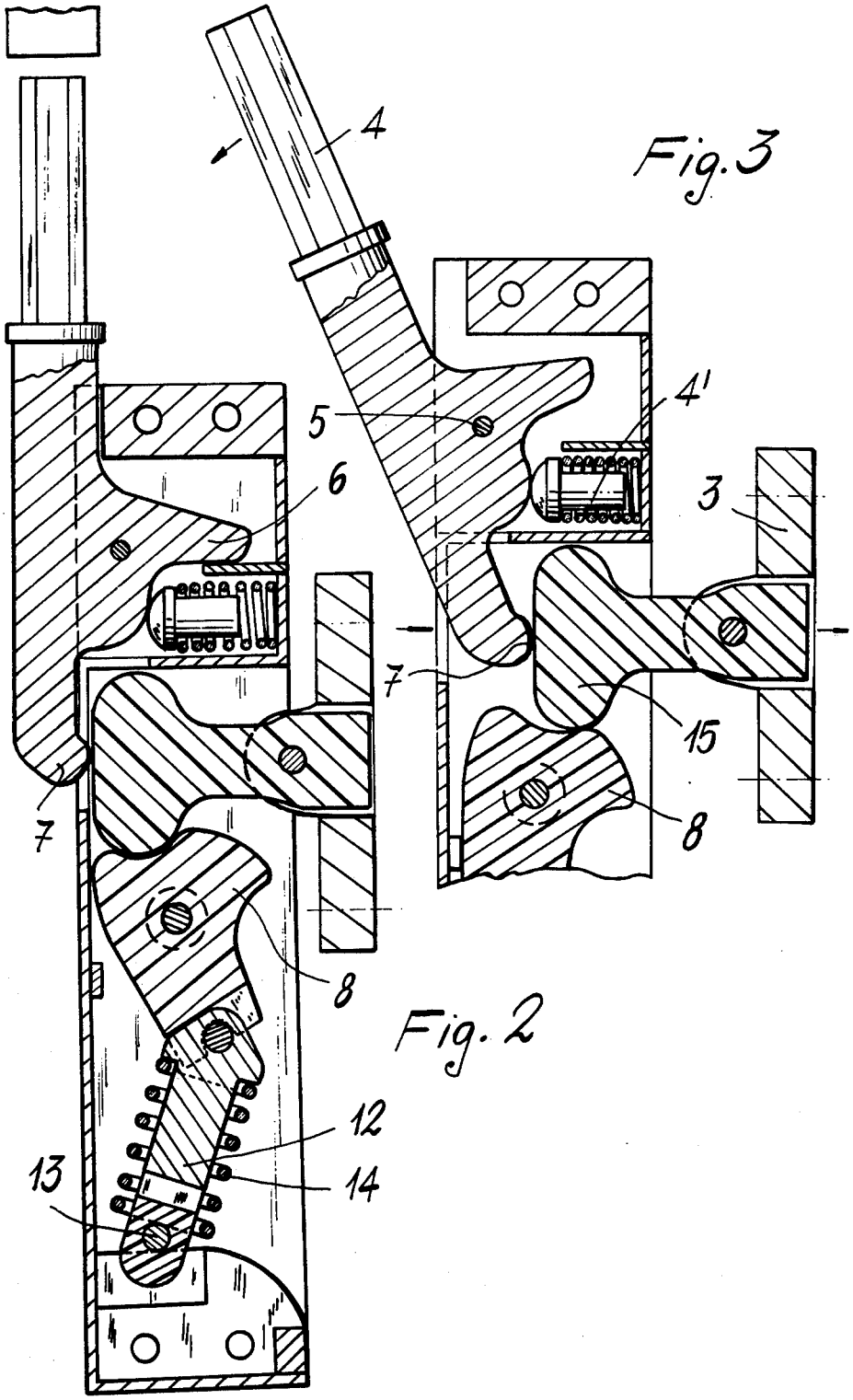
FIG. 2 is a view of the invention at closed position.
FIG. 3 is a view of the invention showing the movement for opening.

Thus, closing of the freezer door is carried out by exerting a slight pressure on the door to bring said nose 8 to abut against the rounded portion of clapper or latch 15. Due to the force exerted by the latter on the "nose", the nose is caused to rotate and catches said latch and holds it in hollow zone 18. At the same time, the movement is transmitted or transferred to plate 11 and spring guide 12, which will move from rest position to operative position, maintaining by means of spring 14 said nose under tension, thus assuring a perfect closure (see FIG. 2).

On the other hand, for opening operation, lever 4 is acted upon and pivots on pin 5 and by means of extension 7 abuts on latch 15, as a result causing the retraction of nose 5 which releases the latch, bringing the whole system back to rest condition.

Figure 4:
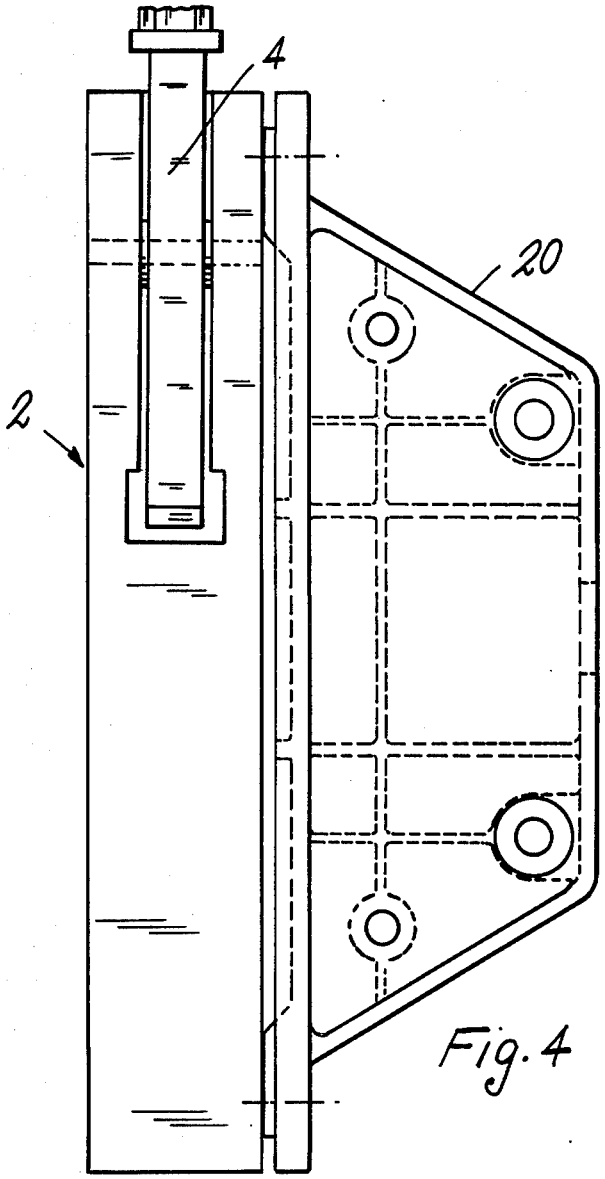
FIG. 4 is a plan view of the closure in combination with a square element when mounting on embedded doors.
Figure 5:
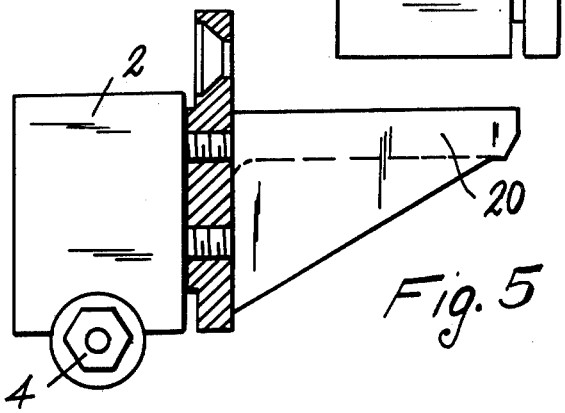
FIG. 5 is a top view still showing the closure in combination with the square element.

When mounting the closure on embedded or semi-embedded doors, square elements 20 are provided (see FIGS. 4 and 5), which are secured by screwing means to the closures, and to the freezer doors, allowing and at the same time assuring the closing of the door.

All of the outside parts making up the invention are coated with coverings made of plastic material.

What is claimed is:

1. A closure, particularly for industrial freezer doors, comprising:

a box-like body having a top portion provided with a horizontal top clearance surface, and a lower portion, there being provided in the lower portion a suitably shaped "nose" element pivoted to the side walls of said box-like body, said nose being articulated by means of a plate to a spring guide element incorporating a spring, said guide element resting as an articulation on suitable notches provided at the bottom of the said body; and a second separable element comprising a substantially mushroom-shaped member, said second element being insertable into the said box-like body between said top closure surface and said nose element, so as to engage said nose element, and tip the nose element over center such that said articulation provides a snap action in tipping behind said mushroom-shaped member, said mushroom-shaped member being thereby retained within the body by means of said nose element so as to make up a secure closure

2. A closure according to claim 1, wherein said mushroom-shaped member is pivoted to a mounting plate, permitting a slight displacement thereof, so that tolerances are provided both as to latch penetration and displacement thereof in the vertical direction, whereby said closure can readily compensate for positioning errors.

3. A closure according to claim 2 wherein right-angle mounting brackets are provided for positioning said closure on freezer doors.

4. A closure according to claims 1, 2, or 3, wherein the closure is provided with a spring-loaded lever, pivoted to the said box-like body, said lever being disposed to press against the face of the mushroom-shaped element when said mushroom element is retained within the said body, so as to force said mushroom element out of said body thereby providing for door opening.

5. A closure according to claim 1, wherein the closure is coated with a covering of suitable plastic material.

* * * * *